United States Patent [19]

Nguyen

[11] 4,081,027

[45] Mar. 28, 1978

[54] SHEAR RAMS FOR HYDROGEN SULFIDE SERVICE

[75] Inventor: Thomas X. T. Nguyen, Beaumont, Tex.

[73] Assignee: The Rucker Company, Houston, Tex.

[21] Appl. No.: 716,502

[22] Filed: Aug. 23, 1976

[51] Int. Cl.[2] ..... E21B 19/00

[52] U.S. Cl. ..... 166/55; 83/694; 72/464

[58] Field of Search ..... 166/55; 148/34; 30/92; 83/694; 251/1 R, 1 A; 29/95 A; 72/38, 334, 464

[56] References Cited

U.S. PATENT DOCUMENTS

| | | | |
|---|---|---|---|
| 3,736,982 | 6/1973 | Vujasinovic | 166/55 |
| 3,817,326 | 6/1974 | Meynier | 166/55 |
| 3,824,887 | 7/1974 | Marchard | 83/679 |
| 3,880,436 | 4/1975 | Canal | 148/34 X |

*Primary Examiner*—Ernest R. Purser
*Assistant Examiner*—Richard E. Favreau
*Attorney, Agent, or Firm*—Fulbright & Jaworski

[57] ABSTRACT

Shear rams shearing drill pipe passing through with blowout preventers encountering hydrogen sulfide are disclosed. The ram bodies are formed of an alloy having an upper hardness level of about Rc22 and the shearing blade and drill string engaging surfaces of the rams are hardfaced with a layer of nickel-based alloys, cobalt-based alloys, and tungsten-based alloys hard enough to shear the drill pipe. The layer of alloy is thin enough to avoid peeling off in use and warping the ram bodies when being welded to them. A number of embodiments and examples of the invention is disclosed.

15 Claims, 6 Drawing Figures

SHEAR RAMS FOR HYDROGEN SULFIDE SERVICE

BACKGROUND OF THE INVENTION

Occasionally, in the drilling of oil and gas wells and particularly in the subsea drilling of oil and gas wells, it is necessary, as an emergency procedure, to shear a drill string and shut off a well. This is accomplished generally by the use of blowout preventers provided with shear rams. Typical of such blowout preventers provided with shear rams are those disclosed in the following U.S. Pat. Nos. 2,919,111, granted Dec. 29, 1959, to K. Murray Nicolson; 2,969,838, granted Jan. 31, 1961, to Arthur E. Wilde; 3,561,526, granted Feb. 9, 1971, to Williams, et al; 3,590,920, granted July 6, 1971, to Orund, et al.; 3,736,982, granted June 5, 1973, to Ado Vujasinovic; and 3,817,326, granted June 18, 1974, and 3,946,806, granted Mar. 30, 1976, to Maurice J. Meynier.

In drilling many wells, an hydrogen sulfide environment is encountered which causes hydrogen embrittlement and hence failure of shear rams having the strength and hardness levels sufficient to shear the heavy drill strings as in a non-hydrogen embrittlement environment. For example, when hydrogen sulfide contacts shear rams made from a steel alloy having a strength and hardness level exceeding that of the drill string to be sheared, say Rc35 – 40, the hydrogen sulfide decomposes to form a metal sulfide and to liberate atomic hydrogen which diffuses into the metal lattice. The metal is then said to be hydrogen embrittled. If a metal is subjected to high stresses, such as in shearing drill strings or in containing high well pressures, brittle failure occurs at stress levels many times lower than the stress required for failure in the absence of hydrogen.

It has been found that alloy steels not exceeding a hardness level of Rc22 may be used successfully in hydrogen sulfide environments since these alloys are tough, resist crack propagation and do not become hydrogen embrittled under stresses. Alloys of such a hardness level, however, have a strength and hardness level less than that of the drill string, and, accordingly, upon engagement with the drill string, these alloys would be deformed and would not shear the drill string, since it is necessary that the hardness of the shear rams exceed the hardness of the drill string in order to prevent deformation and to provide shearing of the drill string.

Shear rams made of alloys of Rc35 – 45 have a strength and hardness which exceed the hardness of most drill strings and thus are not deformed by the drill string and shear the drill string upon engagement with it; however, such alloys are subject to hydrogen embrittlement when used in a hydrogen sulfide environment, and thus crack and fail to shear heavy drill strings. To the inventor's knowledge, prior to the present invention no shear rams were marketed or available which would shear successfully in an hydrogen sulfide environment.

One solution to the problem is to make the shear rams from exotic metals not subject to hydrogen embrittlement which do have a sufficient level of hardness to bite into and shear the drill string without deformation; for example, A-286, MP35N, Waspalloy, Inconel, and Rene' 41. However, these metals are extremely expensive and, hence, it is impractical to make shear rams of these metals.

The foregoing problems and disadvantages are solved and overcome by the provision of, and the present invention is directed to, shear rams having bodies formed of a relatively soft ductile metal, that is, having an upper hardness level of about Rc22, provided with pipe-shearing and pipe-engaging faces or surfaces formed of a relatively thin layer of nickel-based alloys, cobalt-based alloys, and tunsten-based alloys. Unexpectedly, these shear rams are strong enough to shear drill strings passing through blowout preventers and successfully shear drill strings in hydrogen sulfide environments.

The inventor is not aware of any prior publications or uses of shear rams formed of metal alloys having an upper hardness level of Rc22 and provided with shearing faces and drill string pipe-engaging faces formed of nickel-based alloys, cobalt-based alloys, or tungsten-based alloys. The inventor is aware of U.S. Pat. No. 3,880,436, granted Apr. 29, 1975, to Jose Robert Canal, which discloses ram blocks having bodies formed of an alloy having an upper hardness level of Rc22 provided with a supporting inner portion of a relatively soft, work-hardenable alloys, which when relatively stress-free have an upper hardness level of about Rc22 and are not subject to failure because of hydrogen embrittlement, which, upon energizing the ram blocks to bring them into engagement with the tool joint, rapidly work-harden sufficiently to indent themselves into the tool joint and support the drill string load without substantial deformation. This solution is not satisfactory, however, since the inlay is initially softer than the tool joint, it tends to deform and loses its sharp edge and hence does not shear the drill string. In addition, these work-hardenable inlays do not work-harden sufficiently and they crack, particularly at corners, and hence leak.

SUMMARY

The present invention relates to shear rams used in blowout preventers which may be used universally to shear drill strings, that is, under all conditions, including conditions causing hydrogen embrittlement such as use in hydrogen sulfide environments. More particularly, the present invention relates to the discovery that shear rams which have a metal body having an upper hardness level of about Rc22 and thus not subject to failure by hydrogen embrittlement, and provided with drill string shearing and engaging surfaces formed of a relatively thin layer of nickel-based alloys, cobalt-based alloys, and tungsten-based alloys, will effectively shear the drill string when required, under all conditions, and particularly in hydrogen sulfide environments.

It is therefore an object of the present invention to provide shear rams for use in blowout preventers capable of shearing the drill string passing through them and which are not subject to hydrogen embrittlement and thus can be used to shear drill strings in an hydrogen sulfide environment.

A still further object of the present invention is the provision of shear rams formed of an alloy of an upper hardness level of about Rc22 provided with drill string shearing and engaging surfaces formed of nickel-based alloys, cobalt-based alloys, and tungsten-based alloys.

A still further object of the present invention is the provision of shear rams for use in all types of blowout preventers for shearing drill strings, and which may be used under all well conditions, and which may be manufactured readily, easily and economically.

A still further object of the present invention is the provision of shear rams for use in blowout preventers which will shear a drill string, should it become necessary in the course of operation, and which are not subject to hydrogen embrittlement when used in a hydrogen sulfide environment.

Other and further objects, features, and advantages of the present invention will be apparent from other portions of this specification and the claims.

DESCRIPTION OF PREFERRED EMBODIMENTS

Figure 1:
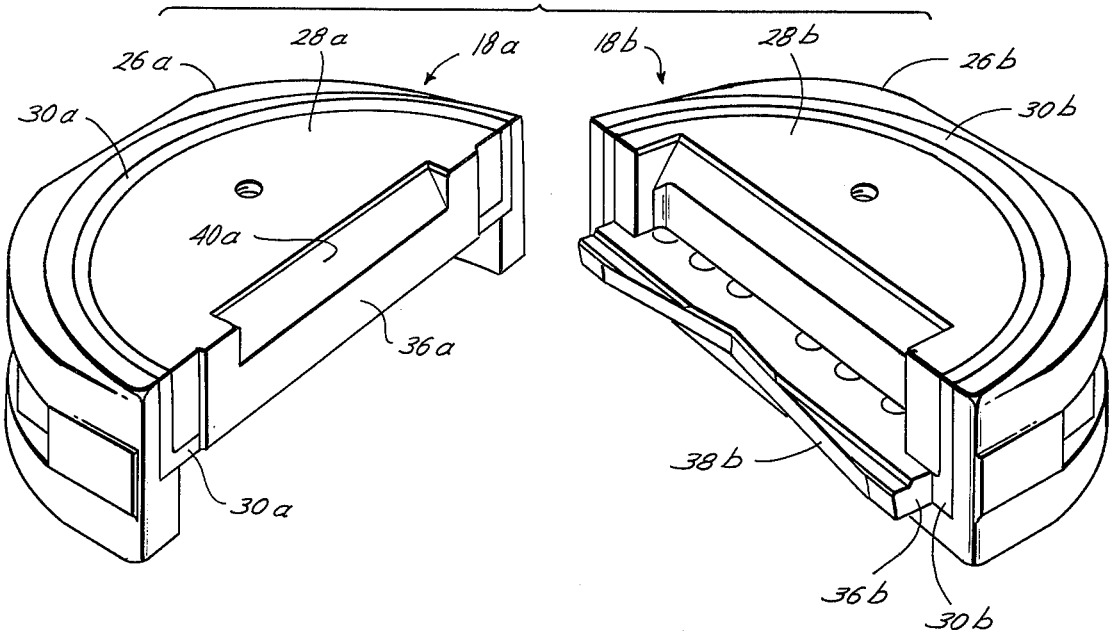
FIG. 1 is a perspective view of shear rams according to the present invention.
Figure 1A:
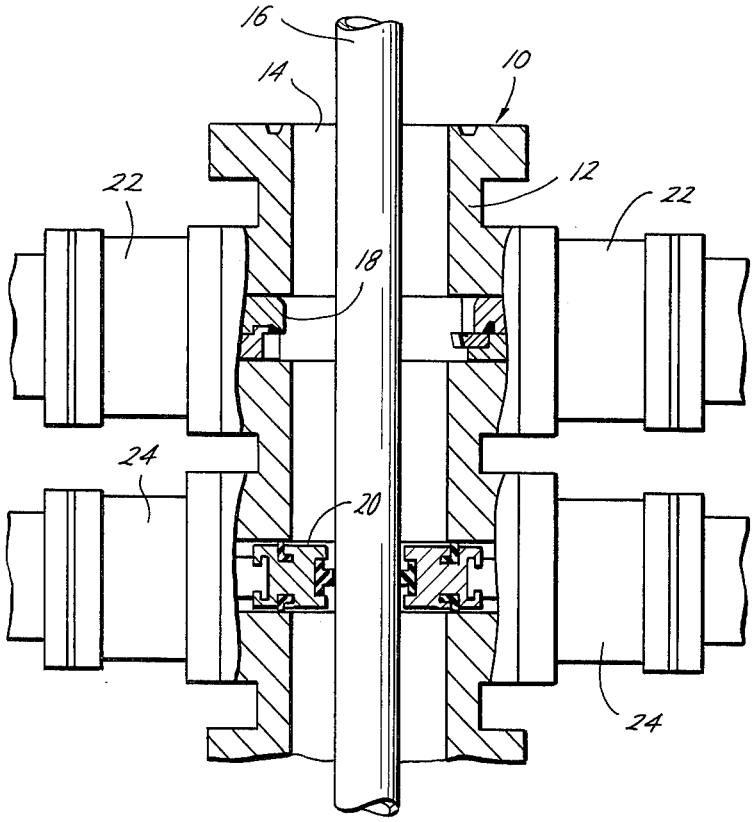
FIG. 1*a* is a partial elevational view, partly in cross-section, showing a blowout preventer and shear rams according to the present invention.

Referring now to the drawings, and particularly to FIG. 1*a*, a conventional blowout preventer 10 is illustrated which may be any conventional type blowout preventer, such as a Rucker-Shaffer LWS hydraulic blowout preventer. The blowout preventer 10 includes a central generally cylindrical body 12 having an enlarged internal passage or bore 14 which is secured to conductor pipe or casing, not shown, used in the drilling of an oil or gas well. A conventional drill string, generally indicated by the reference numeral 16, including sections of drill pipe, tool joints, and other drilling equipment, not shown, passes through the bore 14 of the blowout preventer 10 during normal operations.

The blowout preventer illustrated in FIG. 1*a* is the double cellar control gate type having an upper shear ram assembly, generally designated by the reference numeral 18 and a lower pipe ram assembly, generally indicated by the reference numeral 20.

The body 12 includes ram receiving chambers 22*a* and 22*b* for the shear ram assemblies 18 and ram receiving chambers 24*a* and 24*b* for the pipe ram assemblies 20, all of which ram receiving chambers extend laterally from the bore 14 of the body 12 of the blowout preventer 10 and, as here shown, are opposed to one another as in conventional blowout preventers.

The shear ram receiving chambers 22*a* and 22*b* and the pipe ram receiving chambers 24*a* and 24*b* each include means for actuating these rams into and away from the bore, pistons and cylinders, hydraulic controls and the like, not shown, so that in a retracted or outer position these rams are out of the bore 14 and in an inward position the shear rams 18 move from the outer position to the inner position to engage and shear the drill string in the bore and the pipe rams 20 move from their outer position to the inner position to engage and support the drill string 16.

No more description is given or deemed necessary of the blowout preventer and the manner of actuating the rams for opening or closing them, as the present invention is applicable to all shear rams, can be used with any type of blowout preventer and can be actuated in any desired manner, many of which are well known to and used in the commercial drilling of oil and gas wells. This includes special applications where there is only one movable shear ram, such as illustrated in the Orund, U.S. Pat. No. 3,590,920. Also, no further description is given or deemed necessary of the pipe-engaging ram assemblies 20 since the present invention is directed to rams capable of shearing the drill string 16, when required, such as in emergency situations in hydrogen embrittlement conditions.

Figure 2:
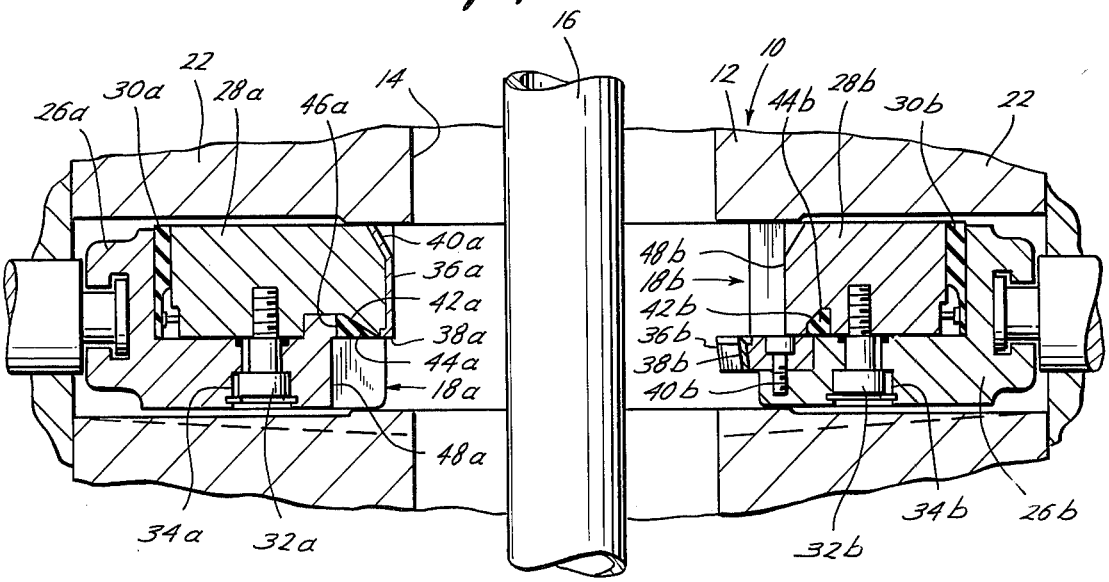
FIG. 2 is an enlarged view of the shear ram section of the blowout preventer of FIG. 1 with the shear rams out of the bore of the blowout preventer.

Referring now to FIGS. 1 and 2, the shear ram assemblies comprise first and second shear ram assemblies designated generally by the reference numerals 18*a* and 18*b*. Each of the shear ram assemblies includes a ram block holder 26*a* and 26*b* of a semicircular configuration, having a substantially concentric, semicircular, upwardly opening recess on their upper sides, into which is secured the semicircular ram blocks 28*a* and 28*b* and the seal members 30*a* and 30*b* disposed along and between at least the circular portions of the ram block holders 26*a* and 26*b* and the ram blocks 28*a* and 28*b*.

Figure 3:
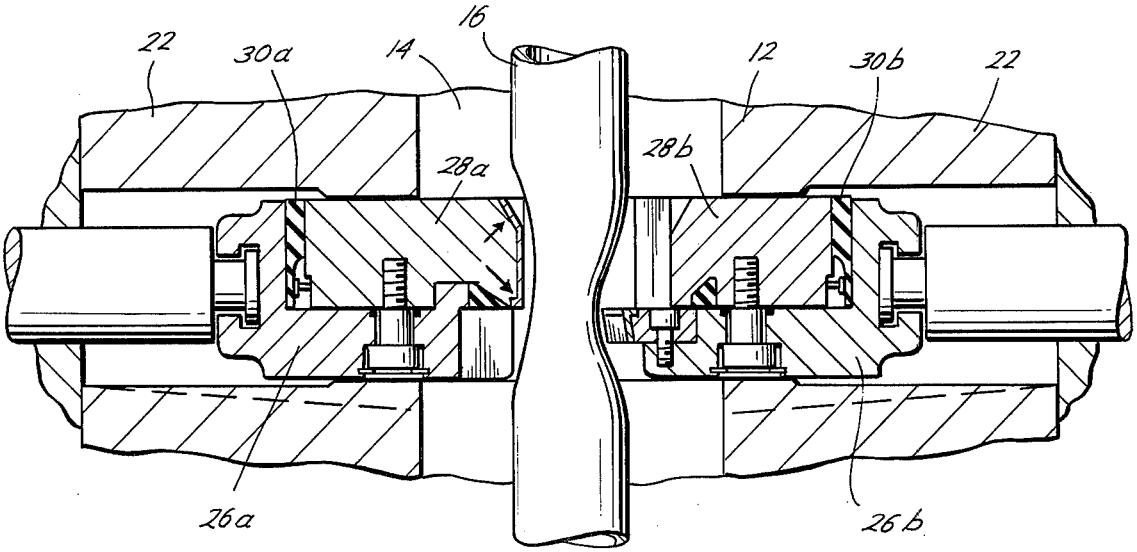
FIG. 3 is a view similar to that of FIG. 2 illustrating the shear rams initially engaging a drill string to be sheared.
Figure 4:
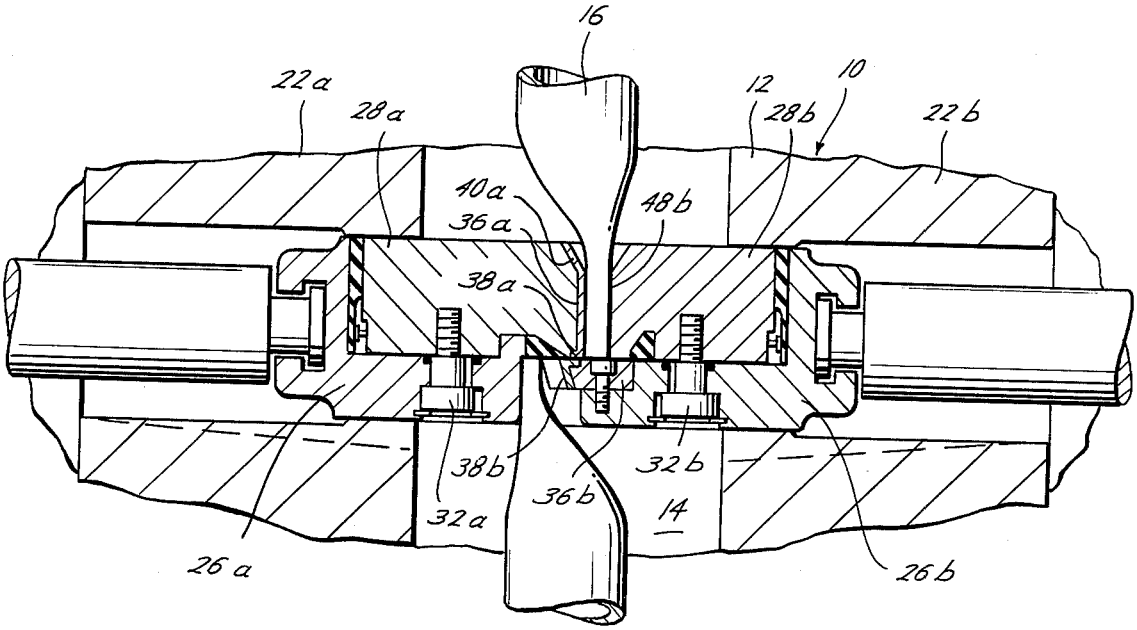
FIG. 4 is a view similar to that of FIGS. 3 and 4 illustrating the shear rams in a closed position having sheared the drill string.

As best illustrated in FIGS. 2, 3 and 4, the shear blocks 28*a* and 28*b* are movably secured within their respective ram block holders 26*a* and 28*b*, such as by the bolts 32*a* and 32*b* secured to the ram blocks 28*a* and 28*b*, respectively, and which bolts 32*a* and 32*b* are disposed within the enlarged openings 34*a* and 34*b* which permit limited inward and outward sliding motion of the ram blocks 28*a* and 28*b* in their respective ram block holders 26*a* and 26*b* for actuating the seals 30*a* and 30*b* after shearing of the drill string 16 has been accomplished, such as illustrated in FIG. 4.

The shear ram assembly 18*a* has a drill string engaging face 36*a* on the inner surface of the ram block 28*a*, which terminates at its lower end with a cutting edge 38*a*, and is tapered outwardly at its upper end as indicated at 40*a*.

The nether side of the ram block 28 is provided with a tapered opening 42*a* extending outwardly from the lower cutting edge 38*a* which extends across the bottom portion of the ram block 28 and into which is disposed a sealing member 44*a* which abuts against the upwardly extending abutment 46*a* on the inner portion of the ram block holder 26*a*. Thus, outer movement of the ram block 28 relative to the ram block holder 26*a* compresses the seal 44*a* against the abutment 46*a* thereby effecting a seal across the shear blade.

Referring now to the shear ram assembly 18*b*, a shear blade 36*b* is provided having the shear blade surface 38*b* which is movably secured to the ram block 26*b* by the threaded bolt 40*b*. A recess 42*b*, which extends across the ram block 28*b* is provided into which is disposed a sealing member 44*b*.

The ram block holder 26*a* and its inner end 48*a* recessed outwardly to provide a space for reception of the lower sheared end of the drill string 16 and the ram block 28*b*, has its outer face 48*a* recessed outwardly to provide a space for reception of the upper sheared end of the drill string, as best illustrated in FIG. 4.

No more description is given or deemed necessary of the shear ram assemblies 18*a* and 18*b* as the shear ram assemblies illustrated in FIGS. 1–4 and described thus far are commercially marketed by The Rucker Company, Rucker-Shaffer Division, and are described in detail in U.S. Pat. No. 3,736,982.

Figure 5:
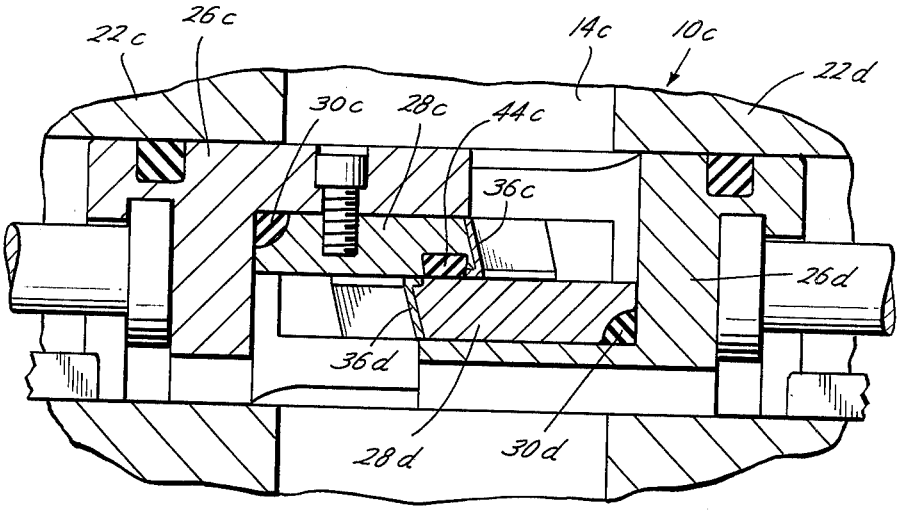
FIG. 5 is a view similar to FIG. 4 illustrating a further embodiment of the invention.

As previously mentioned, the present invention is applicable to all types of shear rams, for example, to shear rams such as illustrated in FIG. 5, to which reference is made, and which shear rams are commercially marketed by Cameron Iron Works, Inc., of Houston, Tex., and are described in detail in U.S. Pat. Nos. 3,817,326 and 3,946,806.

Still with reference to FIG. 5, which is a partial showing of a Cameron Iron Works blowout preventer having shear rams in it, the blowout preventer is indicated by the reference numeral 10*c* and has a passage or bore 14*c* for passage of a drill string, not shown, therethrough. The blowout preventer 10*c* has a pair of ram receiving chambers 22*c* and 22*d* extending laterally from the bore 14*c* and the shear rams 26*c* and 26*d* operably disposed in them which are provided with the seal 30*c* and 30*d* and the seal 44*c* extending across one of the shear blades 28*c* which is adapted to seal with the other shear blade 28*d* after shearing of the drill string, not shown in this view. The shearing and engaging surfaces 36*c* and 36*d* are formed of nickel-based alloys, cobalt-based alloys and tungsten-based alloys. No more detailed description of this particular shear ram assembly is deemed necessary or given, as there is a detailed description of these shear rams in U.S. Pat. Nos. 3,817,326 and 3,946,806.

Prior to the present invention, shear rams such as described above were generally satisfactory to shear drill strings passing through a blowout preventer, when necessary, as in emergency situations, but such commercial shear rams were not satisfactory for use in hydrogen sulfide conditions because hydrogen embrittlement would cause a failure and prevent shearing and, hence, sealing of the well below the blowout preventer.

The present invention is based upon the surprising discovery that by forming the bodies of the shear ram assemblies 28*a* and 28*b* (FIGS. 1–4), and 28*c* (FIG. 5) of an alloy having an upper hardness level of about Rc22 and the shearing surfaces of the shear blades 38*b* and drill string engaging surfaces 36*a* and 40*a* and cutting edge 38*a* of the shear ram assemblies of FIGS. 1–4, and the shearing surfaces and edges 36*c* of the shear ram assemblies of FIG. 5 of a relatively thin layer of nickel-based alloys, cobalt-based alloys, or tungsten-based alloys, that these shear rams can effectively shear drill strings and seal the well below the blowout preventer under hydrogen embrittlement conditions. While a number of specific examples of these alloys are set forth in the following tables, as used herein the term "nickel-based alloys" means alloys which are predominantly nickel, "cobalt-based alloys" means alloys which are predominantly cobalt, and "tungsten-based alloys" means alloys which are predominantly tungsten carbide. Preferably the base alloy, that is, nickel, cobalt or tungsten carbide, should be present in an amount at least about 50% by weight of the particular alloy. All these alloys are hard enough to shear drill pipe.

It is only necessary that the alloy surfaces extend over those portions of the ram block assemblies and shear blades which engage and thus are stressed by the drill string 16 and preferably should extend a short distance beyond the cutting edge or engaging surface. If desired, additional nickel-based alloy, cobalt-based alloy or tungsten-based alloy surfaces can be provided on the ram block assemblies or over the entire surface area of them.

These alloys are welded to the ram block assemblies in a relatively thin layer of a thickness of approximately ¼ inch, which causes a dilution of the underlying base metal for about ⅛ inch, and the surfaces are then ground down to a thickness of about 3/32–⅛ inch leaving about 1/16–⅛ inch of the undiluted alloy. Thicker amounts of the alloy surfacing are not satisfactory due to peeling off of the alloys or warping of the blocks due to differences in thermal expansion and contraction of the alloys and the metal of the blocks, the alloys being much stronger than the metal of the blocks.

Preferably, the ram block is made of a low alloy steel with a controlled hardness preferably in the range of BHN207–235, provided with the alloy surfaces described above.

The following examples of alloys satisfactory for use in the present invention are illustrated, in which all percentages are by weight, in the following examples and tables.

EXAMPLE 1

The following cobalt-based alloys are satisfactory for the pipe-engaging and pipe-shearing surfaces of the ram assemblies.

Table 1.

| Alloy | Nominal Chemical Composition, Per Cent | | | | | | | | | | |
|---|---|---|---|---|---|---|---|---|---|---|---|
| No. | Cr | C | Si | Mn | Mo | Fe | Ni | Co | B | W | Others |
| 1. | 30 | 2.5 | 1.0 | ** | — | 3.0* | 3.0* | Bal. | — | 12 | 1.0 |
| 2. | 28 | 1.1 | 1.0 | ** | — | 3.0* | 3.0* | Bal. | — | 4.0 | 1.5 |
| 3. | 29 | 1.4 | 1.4 | ** | — | 3.0* | 3.0* | Bal. | — | 8.0 | 1.5 |
| 4. | 27 | 0.25 | | ** | 5.5 | 2.0* | 2.8 | Bal. | — | — | 2.0 |
| 5. | 20 | 0.10 | ** | 1.0 | — | 3.0* | 10 | Bal. | — | 15 | 1.5 |
| 6. | 25 | 0.50 | ** | ** | — | 2.0* | 10.5 | Bal. | — | 7.5 | 2.0 |
| 7. | 28 | 1.6 | 1.1 | ** | — | ** | 3.0* | Bal. | — | 4.0 | 1.5 |
| 8. | 21 | 0.07 | 1.6 | — | — | — | — | Bal. | 2.4 | 4.5 | — |
| 9. | 26 | 0.75 | 1.2 | ** | — | 0.75 | 3.0* | Bal. | 0.7 | 5.5 | 1.5 |
| 10. | 32 | 2.5 | ** | ** | — | 3.0* | 2.5* | Bal. | — | 17 | 2.0 |

*Maximum

**Included under Others

The cobalt-based alloys listed in Table 1 can be welded to the drill string engaging and shearing surfaces of shear ram bodies formed of a metal alloy having an upper hardness level of about Rc22, ground as described above, and provide satisfactory shearing of drill strings in hydrogen embrittlement conditions.

EXAMPLE 2

In this example, nickel-based alloys are used for drill string engaging and shearing surfaces, as set forth in the following Table 2.

Table 2.

| Alloy No. | Nominal Chemical Composition, Per Cent | | | | | | | | | | |
|---|---|---|---|---|---|---|---|---|---|---|---|
| | Cr | C | Si | Mn | Mo | Fe | Ni | Co | B | W | Others |
| 11. | 14 | 0.75 | 4.0 | ** | — | 4.0 | Bal. | ** | 3.4 | — | 2.0 |
| 12. | 12 | 0.45 | 3.5 | ** | — | 3.0 | Bal. | ** | 2.5 | — | 1.5 |
| 13. | 17 | 0.85 | 3.9 | ** | — | 2.0 | Bal. | ** | 3.3 | — | 1.5 |
| 14. | 9 | 0.45 | 3.0 | ** | — | 3.8 | Bal. | ** | 2.0 | — | 1.5 |
| 15. | 0.5* | .10* | 2.5 | ** | — | 1.0* | Bal. | — | 1.5 | — | 1.0 |
| 16. | 0.5* | .10* | 3.0 | — | ** | 1.0* | Bal. | ** | 1.8 | — | 1.0 |
| 17. | 16 | 0.40 | 4.0 | — | 2.5 | 3.0 | Bal. | — | 4.0 | — | Cu-2.5 |
| 18. | 20 | .25* | ** | ** | — | 1.0* | Bal. | — | — | — | 4.0 |
| 19. | 1* | .12* | ** | ** | 28 | 5.0 | Bal. | ** | — | — | 5.0 |
| 20. | 16.5 | .12* | ** | ** | 17 | 5.5 | Bal. | 2.5 | — | 4.5 | 2.5 |
| 21. | 22 | 0.10 | ** | ** | 9.0 | 18 | Bal. | 1.5 | — | 0.6 | 2.0 |
| 22. | 5 | .12* | ** | ** | 24 | 5.5 | Bal. | 2.5 | — | — | 2.5 |

*Maximum
**Included under Others

The nickel-based alloys listed in Table 2 are satisfactory for drill string engaging and shearing surfaces of shear rams formed of a metal alloy having an upper hardness level of about Rc22 and will shear drill strings in hydrogen embrittlement conditions.

EXAMPLE 3

In this example, the drill string engaging and shearing surfaces are formed of a tungsten carbide based alloy as set forth in the following Table 3.

Table 3.

| Alloy No. | Nominal Chemical Composition, Per Cent |
|---|---|
| 23. | 90% tungsten carbide and 10% cobalt |
| 24. | 100% tungsten carbide |
| 25. | 50% of No. 23, 50% of No. 13(above) |
| 26. | 15% of No. 23, 85% of No. 13 |
| 27. | 35% of No. 23, 65% of No. 14 |

These tungsten carbide based alloys, when used with shear rams formed of a metal alloy having an upper hardness level of about Rc22, will satisfactorily shear drill strings in hydrogen embrittlement conditions.

The alloys set forth in Tables 1, 2 and 3, are commercially available on the market and are sold under the trademark, "Stellite Powders" by the Wall Colmonoy Corporation of Detroit, Michigan.

EXAMPLE 4

By way of further illustration, the following cobalt-based alloys as set forth in the following Table 4 are satisfactory for use as the drill string engaging and shearing surfaces, which alloys are also available on the commercial market from the Wall Colmonoy Corporation of Detroit, Michigan.

Table 4.

| Alloy No. | Nominal Chemical Composition, Per Cent | | | | | |
|---|---|---|---|---|---|---|
| | Cr | C | Si | Co | W | Other |
| 28. | 30.00 | 2.25 | 1.25 | Bal. | 12.50 | 6.00* |
| 29. | 29.00 | 1.25 | 1.25 | Bal. | 4.50 | 6.00* |

*Maximum

Of the foregoing alloy compositions, No. 29 is particularly suitable for use as pipe engaging and shearing surfaces and is presently preferred.

No more examples of specific nickel-based alloys, cobalt-based alloys and tungsten-based alloys are given or deemed necessary as the foregoing Tables 1–4 illustrate typical and representative compositions of such alloys useful in the present invention.

As previously mentioned, shear rams prior to the present invention did not successfully shear drill strings under hydrogen embrittlement conditions, but when their bodies are formed of a metal alloy having an upper hardness level of Rc22 and their drill string engaging and shearing surfaces are formed of alloys such as set forth in the foregoing Tables, will effectively and successfully shear drill strings passing through blowout preventers under hydrogen embrittlement conditions.

The present invention therefore is well-suited and adapted to attain the objects and has the advantages and features mentioned as well as others inherent therein.

While a number of presently preferred embodiments have been described and illustrated in the drawings for the purpose of the disclosure, changes may be made which are within the spirit of the invention as defined by the scope of the appended claims.

What is claimed is:

1. A blowout prevent comprised of,
a body having a bore therethrough for passage of a drill string and including at least one ram receiving chamber extending laterally from the bore,
a first ram movably disposed in the ram receiving chamber, the ram including a shear blade projecting inwardly toward the drill string,
means to actuate the first ram into and away from the bore,
a second ram in the body having an engaging face arranged to engage the drill string and to coact with the shear blade to shear the drill string,
the first and second rams formed of a material having an upper hardness level of about Rc22, and
the shear blade's shearing surface and the engaging face of the second ram being formed of a layer of an alloy selected from the group consisting of nickel-based alloys, cobalt-based alloys, and tungsten-based alloys welded to the first and second rams, the layer being thin enough so that it does not peel off in use and avoids warping of the rams when being welded to them, the alloys having a hardness sufficient to shear the drill string.

2. The blowout preventer of claim 1, where
the body includes a second ram receiving chamber extending laterally from the bore and opposed to the first ram receiving chamber, and
the second ram is movably disposed in the second ram receiving chamber, and including
means to actuate the second ram into and away from the bore.

3. The blowout preventer of claim 1, including
means for sealing the ram receiving chamber and the bore after shearing the drill string.

4. The blowout preventer of claim 1, where
the body includes a second ram receiving chamber extending laterally from the bore and opposed to the first ram receiving chamber, and the second ram is movably disposed in the second ram receiving chamber, and including means to actuate the second ram into and away from the bore, and the second ram has a shearing edge on its engaging face coacting with the shear blade.

5. The blowout preventer of claim 1, where the body includes a second ram receiving chamber extending laterally from the bore and opposed to the first ram receiving chamber, and the second ram is movably disposed in the second ram receiving chamber and has a shearing edge on its engaging face, and including means to actuate the second ram into and away from the bore, and means for sealing the ram receiving chambers and the bore after shearing the drill string.

6. A blowout preventer for shearing a drill string passing therethrough and sealing off a well therebelow comprising, a generally cylindrical body arranged to be connected to casing and having a bore through which the drill string passes into the casing, a pair of ram receiving chambers extending laterally from the bore, a ram movable in each ram receiving chamber from an outer position within the chamber out of the bore to an inner position across the bore, one of the rams having a shear blade projecting inwardly, the other of the rams having an inner face provided with a cutting edge coacting with the shear blade to shear the drill string, means operable to move the rams from the outer position to the inner position to engage and shear the drill string on the bore, the pair of rams formed of a material having an upper hardness level of about Rc22, the shear blade's surface of the one ram and the inner face and cutting edge of the other ram formed of a layer of an alloy selected from the group consisting of nickel-based alloys, cobalt-based alloys, and tungsten-based alloys welded to the rams, the layer being thin enough so that it does not peel off in use and avoids warping of the rams when being welded to them, the alloys having a hardness sufficient to shear the drill string, and sealing means on the shear rams operable to seal the bore and the ram receiving chambers after shearing of the drill string.

7. The blowout preventer of claim 6, where the sealing means includes a seal extending across one ram operable to seal against the other ram.

8. The blowout preventer of claim 6, where, the inner face of the other ram includes a shear blade.

9. The blowout preventer of claim 6, where, the inner face of the other ram includes a shear blade, and, the sealing means includes a seal extending across one ram operable to seal against the other ram.

10. A shear ram adapted to be moved laterally across and out of the bore of a blowout preventer to cooperate with another ram to shear a drill string in the bore comprising, a body having an inner surface provided with a cutting edge formed of an alloy having an upper hardness level of about Rc22, the inner surface and cutting edge of the body formed of a layer of an alloy selected from the group consisting of nickel-based alloys, cobalt-based alloys, and tungsten-based alloys welded to the body, the layer being thin enough so that it does not peel off in use and avoids warping of the rams when being welded to them, the alloys having a hardness sufficient to shear the drill string.

11. The shear ram of claim 10, where, the body includes a seal extending thereacross operable to seal against the second ram.

12. The shear ram of claim 10, where, the inner surface and the cutting edge comprise a shear blade.

13. The shear ram of claim 10, where, the inner surface and the cutting edge comprise a shear blade, and, including a seal extending across the body operable to seal against the second ram.

14. A ram adapted to move laterally across and out of the bore of a blowout preventer to cooperate with a shear ram to shear a drill string in the bore, comprising, a body having an inner surface operable to engage the drill string formed of an alloy having an upper hardness level of about Rc22, the inner surface formed of a layer of an alloy selected from the group consisting of nickel-based alloys, cobalt-based alloys, and tungsten-based alloys welded to the body, the layer being thin enough so that it does not peel off in use and avoids warping of the ram when being welded to it, the alloys having a hardness sufficient to effectively cooperate with the shear ram to shear the drill string.

15. The shear ram of claim 14, including, a seal extending across the body operable to seal against the shear ram after shearing of the drill string.

* * * * *

UNITED STATES PATENT OFFICE

CERTIFICATE OF CORRECTION

Patent No. 4,081,027 Dated March 28, 1978

Inventor(s) Thomas X. T. Nguyen

It is certified that error appears in the above-identified patent and that said Letters Patent are hereby corrected as shown below:

Under ABSTRACT, Line 1, after the word "rams", add the word "for"

Also under ABSTRACT, Line 1, delete the word "with"

Column 4, Line 8, delete the words "U.S. Pat.", add the word "patent,"

Column 4, Line 59, delete the word "and", add the word "has"

Column 5, Line 8, change "Tex." to "Texas,"

Column 9, Line 36, change "on" to "in"

UNITED STATES PATENT OFFICE
CERTIFICATE OF CORRECTION

Patent No. 4,081,027 Dated March 28, 1978

Inventor(s) Thomas X. T. Nguyen

It is certified that error appears in the above-identified patent and that said Letters Patent are hereby corrected as shown below:

Column 2, line 8, delete the work "tunsten-based", add the word "tungsten-based"

Column 4, line 28, change the "28b" to "26b"

Column 8, line 31, change "prevent" to "preventer"

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*